US005228378A

United States Patent [19]

Bathory

[11] Patent Number: 5,228,378

[45] Date of Patent: Jul. 20, 1993

[54] FORCE APPLICATOR

[75] Inventor: Bela I. Bathory, Yorkshire, England

[73] Assignee: Davy McKee (Sheffield) Limited, Yorkshire, England

[21] Appl. No.: 775,997

[22] PCT Filed: May 11, 1990

[86] PCT No.: PCT/GB90/00725

§ 371 Date: Jan. 2, 1992

§ 102(e) Date: Jan. 2, 1992

[87] PCT Pub. No.: WO90/14471

PCT Pub. Date: Nov. 29, 1990

[30] Foreign Application Priority Data

May 16, 1989 [GB] United Kingdom ..... 8911125

[51] Int. Cl.[5] ..... F15B 21/04

[52] U.S. Cl. ..... 92/80; 92/82; 92/181 P; 384/12; 384/99

[58] Field of Search ..... 92/80, 82, 181 R, 181 P, 92/117 R, 75; 384/12, 99, 100; 248/638

[56] References Cited

U.S. PATENT DOCUMENTS

| | | | |
|---|---|---|---|
| 3,325,229 | 6/1967 | Webb | 384/12 |
| 3,782,793 | 1/1974 | Sinner | 384/99 |
| 3,799,628 | 3/1974 | Van Gaasbeck et al. | 384/12 |
| 4,113,325 | 12/1978 | Miller | 384/12 |
| 4,749,282 | 6/1988 | Spargo et al. | 384/99 |
| 4,941,250 | 7/1990 | Kusters | 384/99 |

FOREIGN PATENT DOCUMENTS

| | | | |
|---|---|---|---|
| 1201124 | 8/1970 | United Kingdom | 384/12 |
| 1205487 | 9/1970 | United Kingdom | 384/12 |
| 1292175 | 10/1972 | United Kingdom | 384/12 |

*Primary Examiner*—Thomas E. Denion
*Attorney, Agent, or Firm*—Lee, Mann, Smith, McWilliams, Sweeney & Ohlson

[57] ABSTRACT

A force applicator comprises a ram operable by fluid under pressure. A pressure pad (7) is located between one movable part of the ram (3) and the load (9) and means are provided which enable relative movement to take place between the pressure pad and the ram in a direction at right angles to the direction of operation of the ram. The means may take the form of a fluid chamber (15) between the pressure pad and the ram or a disc of PTFE between them.

6 Claims, 1 Drawing Sheet

FORCE APPLICATOR

Rams operable by fluid pressure are employed in many industrial applications in order to apply a force, usually between a rigid foundation and a load plate. The ram consists basically of a piston displaceable in a cylinder with a part projecting from one end of the cylinder and, in use, either the cylinder bears against a rigid foundation and the piston is displaced to apply force to the load plate, or the piston bears against the rigid foundation and the cylinder is displaceable to apply a force against the load plate. In some applications it is desirable to slide the load plate relative to the part of the ram against which it abuts. This is usually impossible to attain once pressure has been applied to the ram.

According to the present invention, a force applicator comprises a ram having a cylinder, a piston displaceable in the cylinder with a part projecting from one end of the cylinder, and means for introducing fluid under pressure into the cylinder to displace the piston; and a pressure pad abutting against either the end wall of the cylinder opposite the end from which the part projects or the end wall of the part projecting from the cylinder, said pressure pad being slideable with respect to the surface against which it abuts in a direction normal to the direction of movement of the piston, and is characterised in that between the pressure pad and the wall against which it abuts there is a space defined by a recess in the pressure pad or wall and means are provided for introducing fluid under pressure into said space.

The force required to bring about relative movement between the ram and the pressure pad is conveniently less than 10% of the applied load.

Figure 1:
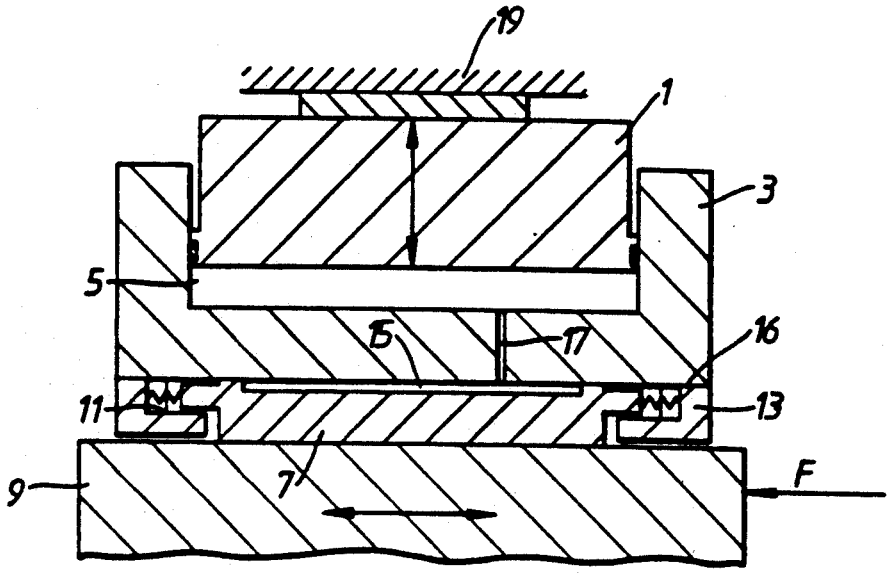
Figure 2:
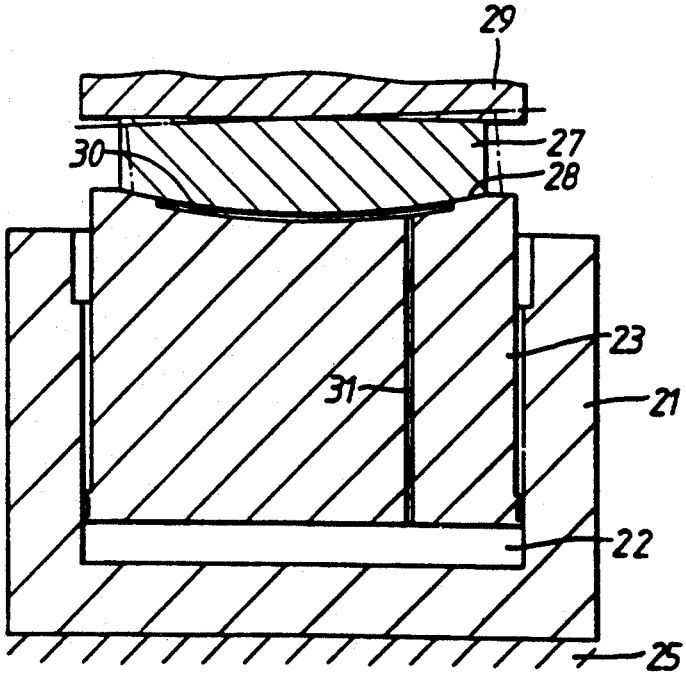

In order that the invention may be more readily understood, it will now be described, by way of example only, with reference to the accompanying drawings, in which:

FIG. 1 shows diagrammatically the force applicator applied to a part of a rolling mill; and FIG. 2 shows an alternative embodiment of the invention applied to a rolling mill.

Referring to FIG. 1, a hydraulically operable ram comprises a piston 1 displaceable in a cylinder 3 and having a part which projects out of the cylinder. To displace the piston, fluid is introduced into the cylinder chamber 5 by means (not shown). An outer wall surface 16 of the cylinder 3 extends transverse to the direction of relative movement between the piston and the cylinder and a pressure pad 7 bears against this surface. The opposite surface of the pressure pad bears against a load plate 9 which forms a chock for rotatably supporting one end of the roll of a rolling mill. The pressure pad 7 is centred relative to the cylinder 3 by actuating means such as springs 11 or hydraulic means within an annular bracket 13 on the underside of the cylinder 3.

The surface of the pad 7 which is adjacent the surface 16 of the cylinder is recessed over its central portion and the space 15 defined by the walls of the recess and the surface 16 of the cylinder is in communication with the chamber 5 by way of a bore 17 extending through the wall of the cylinder. Alternatively, the surface of the pad may be flat with the surface 16 of the cylinder having a recess therein.

In use, the force applicator is positioned between the load plate 9 and a rigid foundation 19 and fluid is introduced into the chamber 5 of the ram in order to apply a load between the foundation and the load plate 9. The area of the space 15 between the pressure pad and the cylinder is approximately 80% of the area of the chamber 5 and, if the same fluid pressure exists in the chamber 5 and the space 15, the force between the pressure pad and the cylinder is considerably reduced and, by suitable selection and lubrication of the sliding surfaces, a coefficient of friction of about 0.2 between them can be achieved. This means that the side force required on the pressure pad 7 to displace it transverse to the line of action of the load exerted by the ram is approximately 4% of this load. A limited transverse movement of the pressure pad 7 is caused by movement of the load plate 9 transverse to the line of action of the force applied by the ram.

In the arrangement shown in FIG. 2, the cylinder 21 of the ram defines a chamber 22 in which the piston 23 is displaceable. The ram is mounted on a rigid foundation 25 and a pressure pad 27 is located between the outer surface 28 of the piston and a load plate 29 which may constitute a chock for rotatably mounting one end of the roll of a rolling mill. The upper surface 28 of the piston is of concave spherical form and the adjacent surface of the pressure pad 27 is of corresponding convex form. A recess 30 is formed in the upper surface of the piston and this recess is in communication with the chamber 22 of the cylinder by a bore 31 extending through the piston. Again, the area of the recess 30 is conveniently 80% of the area of the chamber 22 and the sideways force required to bring about tilting of the pressure pad 27 with respect to the piston 23 is approximately 4% of the load applied by the ram between the rigid foundation 25 and the load plate 29. In an alternative arrangement the space 15 or recess 30 is not in communication with the interior of the cylinder but is connected to a separate external source of fluid under pressure.

In the arrangements described above, the direction of movement of the piston or cylinder has been generally vertical but the free applicator can be used so that the direction of movement of the piston/cylinder is generally horizontal. An application for such an arrangement is the use of the applicator to control the vertical edger rolls of a rolling mill.

We claim:

1. A force applicator comprising:

a ram having a cylinder with a pair of opposite end walls, a piston displaceable in the cylinder with a part of the piston projecting from the cylinder through one of said end walls, a separate pad retained in abutting relation with the other end wall of the cylinder but slidable with respect to the wall against which it abuts in a direction normal to the direction of movement of the piston, the pad and said end wall against which it abuts together defining a recess, means for introducing fluid under pressure into the recess, and means for introducing fluid under pressure into the cylinder to displace the piston whereby force can be applied between the surfaces engageable with the piston and the pad respectively.

2. A force applicator as claimed in claim 1 wherein the recess and the inside of the cylinder are in communication with each other by way of a bore extending through said other end of the cylinder against which the pad abuts.

3. A force applicator as claimed in claim 1 wherein the pad is retained against the end wall of the cylinder by means including actuating means which cause the pad to take up a predetermined position relative to the end wall when no load is applied to the pad by the action of the ram.

4. A force applicator comprising;

a ram having a cylinder with a pair of opposite end walls, a piston displaceable in the cylinder with a part of the piston projecting through one of the end walls, separate pad retained in abutting relation with the end wall of the part of the piston projecting from the cylinder and slidable with respect to the wall against which it abuts in a direction normal to the direction of movement of the piston, the pad and the wall of the piston against which it abuts together defining a recess, means for introducing fluid under pressure into the recess and means for introducing fluid under pressure into the cylinder to displace the piston whereby force can be applied between surfaces engageable with the pad and the other of the ends walls of the cylinder respectively.

5. A force applicator as claimed in claim 4 wherein the recess and the inside of the cylinder are in communication with each other by way of a bore extending through the piston.

6. A force applicator as claimed in claim 5 wherein the abutting surfaces of the pad and the piston are of corresponding arcuate form.

* * * * *